United States Patent [19]

Hensler

[11] Patent Number: 4,520,894

[45] Date of Patent: Jun. 4, 1985

[54] CONTROL WAND FOR OVERHEAD PERSONNEL CRANE

[76] Inventor: David L. Hensler, 3814 Darwood Ct., Fort Wayne, Ind. 46815

[21] Appl. No.: 481,621

[22] Filed: Apr. 4, 1983

[51] Int. Cl.[3] ..... H01H 25/04

[52] U.S. Cl. ..... 182/2; 200/6 A

[58] Field of Search ..... 182/2, 141, 148, 63; 200/6 A

[56] References Cited

U.S. PATENT DOCUMENTS

| | | | |
|---|---|---|---|
| 2,627,560 | 2/1953 | Eitel | 182/2 |
| 2,679,678 | 6/1954 | Stephan | 200/6 A |
| 3,293,381 | 12/1966 | Eitel | 200/6 A |
| 3,401,240 | 9/1968 | Groves | 200/6 A |
| 3,828,148 | 8/1974 | Roeser | 200/6 A |
| 4,041,258 | 8/1977 | Harada | 200/6 A |
| 4,181,827 | 1/1980 | Diepeveen | 200/6 A |
| 4,218,702 | 8/1980 | Brocard | 200/6 A |
| 4,237,629 | 12/1980 | Schmidt | 200/6 A |
| 4,330,694 | 5/1982 | Ogawa | 200/6 A |
| 4,382,166 | 5/1983 | Kim | 200/6 A |

*Primary Examiner*—Reinaldo P. Machado

*Attorney, Agent, or Firm*—George A. Gust

[57] ABSTRACT

The invention is a manually operable control wand for use with hydraulically actuated overhead personnel cranes or "Cherry Pickers". The wand is fixedly secured to a personnel carrying enclosure and includes a pair of operating shafts operatively coupled together and to a mounting base. A plurality of electrical switches which effect operation of the hydraulic actuator means of the overhead personnel crane and mounted adjacent the operator levers in positions such that movement of the operating levers in positions such that movement of the operating levers in the direction of desired movement of the personnel enclosure produces the corresponding movement of the enclosure.

19 Claims, 5 Drawing Figures

CONTROL WAND FOR OVERHEAD PERSONNEL CRANE

BACKGROUND OF THE INVENTION

1. Field of the Invention

The present invention relates to hand operated controls for hydraulic devices and particularly to such a device used in conjunction with a hydraulic personnel lifting crane which provides maneuvering of the crane by means of a single operating handle and in which movement of the "bucket" carrying the person is effected by movement of the control handle in the direction of desired movement.

2. Description of the Prior Art

The mobile aerial tower comprises an elongated, articulated arm which can be extended by means of hydraulic cylinders and related linkages and which has a basket or "bucket" fixed to the distal end thereof for the purpose of elevating workers in such applications as the repair of telephone lines, picking fruit, fighting fires, and the like. Such devices have become known, and are commonly referred to as "cherry pickers". Such devices are typically mounted on a vehicle such as a truck and provide a convenient and efficient apparatus which enables workers in various occupations to perform their functions in elevated locations.

The cherry picker is typically provided with a series of switches mounted adjacent the upper periphery of the personnel carrying bucket. These switches are, in turn, connected to one or more hydraulic valves which control the flow or hydraulic fluid to a plurality of cylinders which effect the raising, lowering, and similar movements of the bucket. This of course enables the operator to position himself conveniently to his work and to otherwise control his position while in the bucket.

However, the control switches provided in prior art cherry pickers have comprised a plurality of separate switches, there being a different switch for effecting control of elevation, a second switch for controlling right and left hand movement, and a third switch for effecting forward and reverse movement of the bucket and in some units, a fourth interlock switch for preventing inadvertant movement of the bucket. Reliance on the workers sense of feel is unreliable since the worker is typically wearing heavy work gloves. Accordingly, when utilizing such an arrangement of switches, it is frequently necessary for the operator to remove his eyes from his intended work object to observe the switches and insure that he has selected the proper switch to manipulate the bucket. In the alternative, it is possible for the operator to operate an incorrect one of the switches thereby effecting the movement of the bucket in an undesired direction. This can be not only inconvenient but, in the event that the worker is working adjacent dangerous objects such as high power lines, such inadvert movement can be highly dangerous.

SUMMARY OF THE INVENTION

The present invention has as its objective to provide a manually operated control handle or wand which is mounted adjacent the upper periphery of the personal carrying bucket and which produces the desired control signals for manipulation of the bucket by a corresponding movement of the wand in the direction of desired movement. Because control of the bucket is thus effected utilizing a single control, it is no longer necessary for operator to remove his eyes from his work object and, because movement of the wand in a particular direction results in corresponding movement of bucket in that direction, precise and predictable control of the bucket results.

In its broader aspects, the manually operated control wand includes an elongated handle portion which is mounted to a supporting base for movement in combinations of vertical and horizontal directions and including a slide mounting which enables forward and reverse movement of the wand. The proximal end of the wand assembly engages one or more of a plurality of switches in response to axial movement of the wand which effect movement of the bucket in the desired forward or reverse direction. The wand itself is spring biased to assume a neutral position if the absence of external force.

It is therefore an object of the invention to provide and inproved, manually operable switch assembly for use with an overhead personnel crane.

Another object of the invention is to provide such an apparatus which permits precise and predictable operation of the crane without visual observation of the operating apparatus.

Still another object of the invention is to provide such an operating device which effects movement of the personnel carrying bucket in the direction of movement of the operating wand.

Yet another object of the invention is to provide such a device which is simple and rugged in construction and reliable in operation.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings wherein.

DESCRIPTION OF PREFERRED EMBODIMENT

Figure 1:
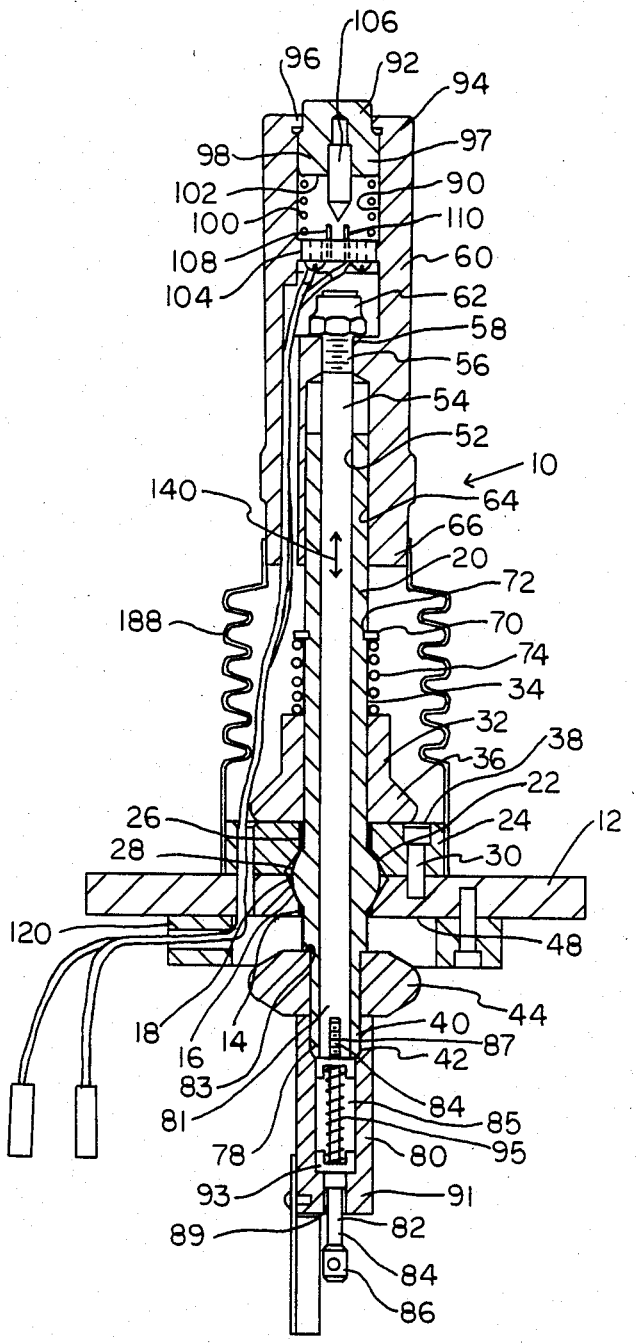
FIG. 1 is an axial sectional view of the operating wand in accordance with the present invention.

Referring now to the drawings, there is shown in FIG. 1 a manually operable control wand for an overhead personnel crane shown in cross-section and denoted generally by numberal 10. The device comprises a mounting base or plate 12 of generally rectangular cross-section. A circular hole 14 is formed through the center of plate 12, hole 14 being provided with a tapered surface portion 16 at its upper (as viewed in FIG. 1) end 18. An elongated operating shaft 20, which includes an enlarged, spherical portion 22 adjacent its center is received with the spherical portion 22 in the tapered portion 16 of hole 14.

A retaining plate 24, is also provided with a central opening 26 and a tapered portion 28 which is received over the spherical portion 22 of shaft 20, recesses 18, 28 defining a socket. The plate 24 is secured by means of threaded fasteners 30 and secures the shaft 20 to the mounting plate 12 while permitting the shaft 20 to be swiveled or moved in any desired or horizontal (as viewed in FIG. 1) direction.

A collar 32 made of a rigid material is slidably secured to the outer surface 34 of shaft 20. Collar 32 includes an enlarged tapered flange 36 which abuttingly engages the upper surface 38 of retaining plate 24.

A lock ring 70 is fixedly engaged in a complementarly slot 72 provided in the outer surface 34 of shaft 22 about midway between the collar 32 and bottom 66 of handle 60. A compression spring 74 is disposed between the ring 70 and collar 32.

Shaft 20 is also provided with a reduced diameter portion 40 at its lower (as viewed in FIG. 1) end 42. A donut shaped collar 44 is fixedly secured to the shaft 20 about the reduced diameter portion 40 in a position with its upper surface 46 disposed in spaced-apart relationship to the under-surface 48 of mounting plate 12. Thus configured, it will be seen that when the shaft 20 is deflected, the flanged collar 32 will be urged upwardly and because of spring 74, will establish a lever force to automatically, in the absence of a deflecting force, cause the shaft to return to its normal centered position as shown in FIG. 1.

It can further be seen in reference to FIG. 1 that shaft 20 is hollow, having an internal bore 52 extending longitudinally therethrough. An internal shaft 54 is slidably received in the bore 52, as indicated by arrows 140.

The upper end 56 of shaft 54 is threaded at 56. The threaded portion 56 is in turn threadingly engaged with threaded bore 58 provided in a molded, generally cylindrical handle 60. The shaft 54 is further secured by means of lock nut 62 to prevent turning or other disengagement between the handle 60 and shaft 54.

Handle 60 is provided with an internal bore 64 extending partially therethrough from its lower (as viewed in FIG. 1) end 66. This bore is dimensioned to slidably engage the outer surface 34 of shaft 22.

Fixedly secured to the lower (as viewed in FIG. 1) end 78 of shaft 54 is an elongated retainer 80 of hexagonal cross-section. Ratainer 80 is secured by means of threads 87 therein and on the external surface of end 81 of shaft 54. Retainer 80 secures the collar 44 against a shoulder 83 formed on shaft 20. Retainer 80 has a hollow bore 85 extending from thread 87 to a reduced diameter hole 89 extending through the bottom wall 91 of the retainer 80. A pair of cupped spring retainers 93 are disposed at opposite ends of bore 85 and a compression spring 95 is compressed therebetween. Thus configured, it will be seen that the shaft 54 is normally maintained in a centralized or neutral portion but can be moved upwardly or downwardly in response to forces applied to handle 60.

An elongated cam shaft 82 is fixedly secured to and depends downwardly from the shaft 52, shaft 82 being secured by means of threads 87. Shaft 82 is provided at its lower end 84 with an enlarged cam portion 86.

The upper end of handle 60 is provided with a second cylindrical bore 90 in which is slidably received a push button 92 which extends outwardly from the upper end 94 of the handle 60. Push button 92 is of stepped diameter and is retained within the bore 90 by a flange 96 which abutingly engages the larger diameter portion 98 of push button 92. Push button 92 is further urged into its upwardly extended position (shown in FIG. 1) by a compression spring 100 which is compressably received between the lower surface 102 of push button 92 and a switch plate 104. An electrical contact is fixedly received in the bottom 97 of the push button 92, contact 106 effecting electrical contact between electrical terminals 108, 110 and switch plate 104, when the push button 92 is depressed as by an operators thumb.

A group of four momentary contact switches 112, 114, 116, and 118 are fixedly secured to the bottom surface of a switch mounting plate 120, the latter being secured to the under surface of mounting plate 12. The switches are arranged with their actuating buttons 122 disposed in closely spaced-apart relationship to the outer periphery of collar 44. Thus configured, it will be seen that when the handle 60 is deflected, resulting in corresponding deflection of the shaft 54, collar 44 will engage and thereby actuate one or adjacent pairs of switches 112, 114, 116, or 118. Specifically, movement of the handle which produces movement as indicated by arrows 124, or 126 will effect actuation of either switch 118 or 114, respectively. Similarly, movement in the direction of the arrows 128 or 130 will effect operation of switches 112 or 116 respectively. Movement of the collar in the direction of arrows 132, 134, 136, or 138 will result in actuation of respective pairs of switches 118, 112, 112, 114, 114, and 116, or 116 and 118, respectively.

Figure 2:
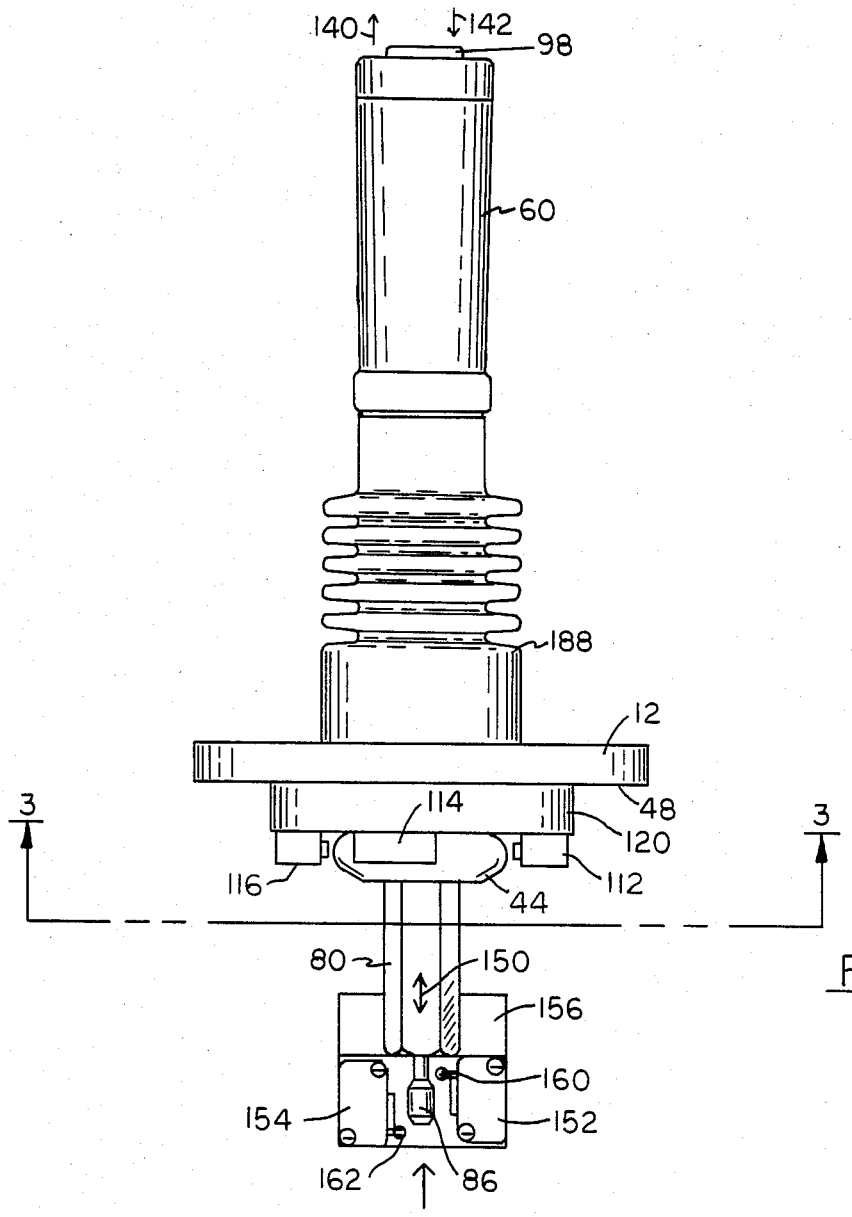
FIG. 2 is a side plan view of the apparatus.
Figure 3:
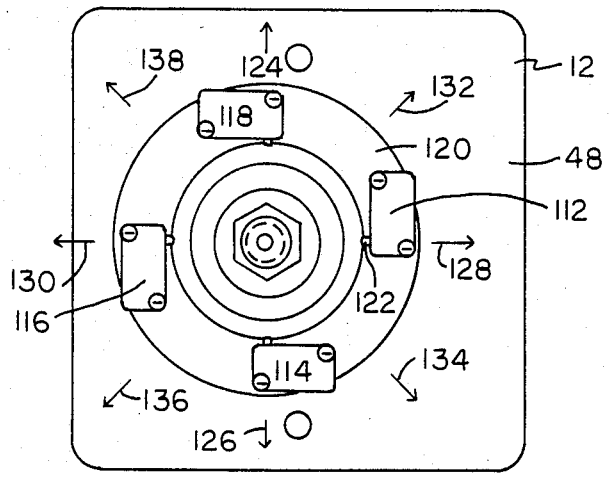
FIG. 3 is a bottom plan view taken along section line 3—3 of FIG. 2.

A pair of switches 152, 154 (shown in FIG. 2 only) are fixedly mounted by means of a mounting plate 156 to the shaft retainer 80 with their actuating levers 160, 162 respectively disposed above and below the cam portion 86. Correspondingly, movement of the cam portion in the directions of arrow 140 will result in actuation of switch 152 or switch 154.

Figure 5:
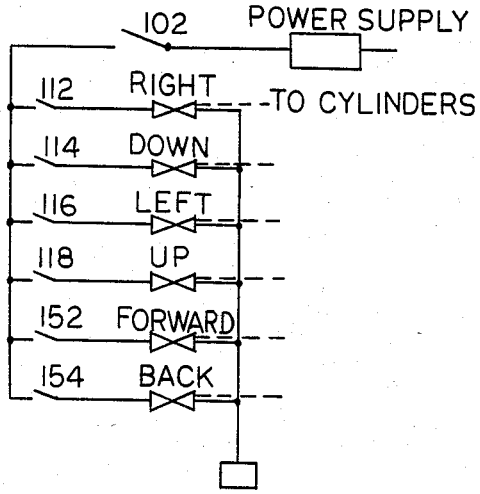
FIG. 5 is a shematic diagram showing the relationship of the wand switches and hydraulic system of a system utilizing the control of the present invention.
Figure 4:
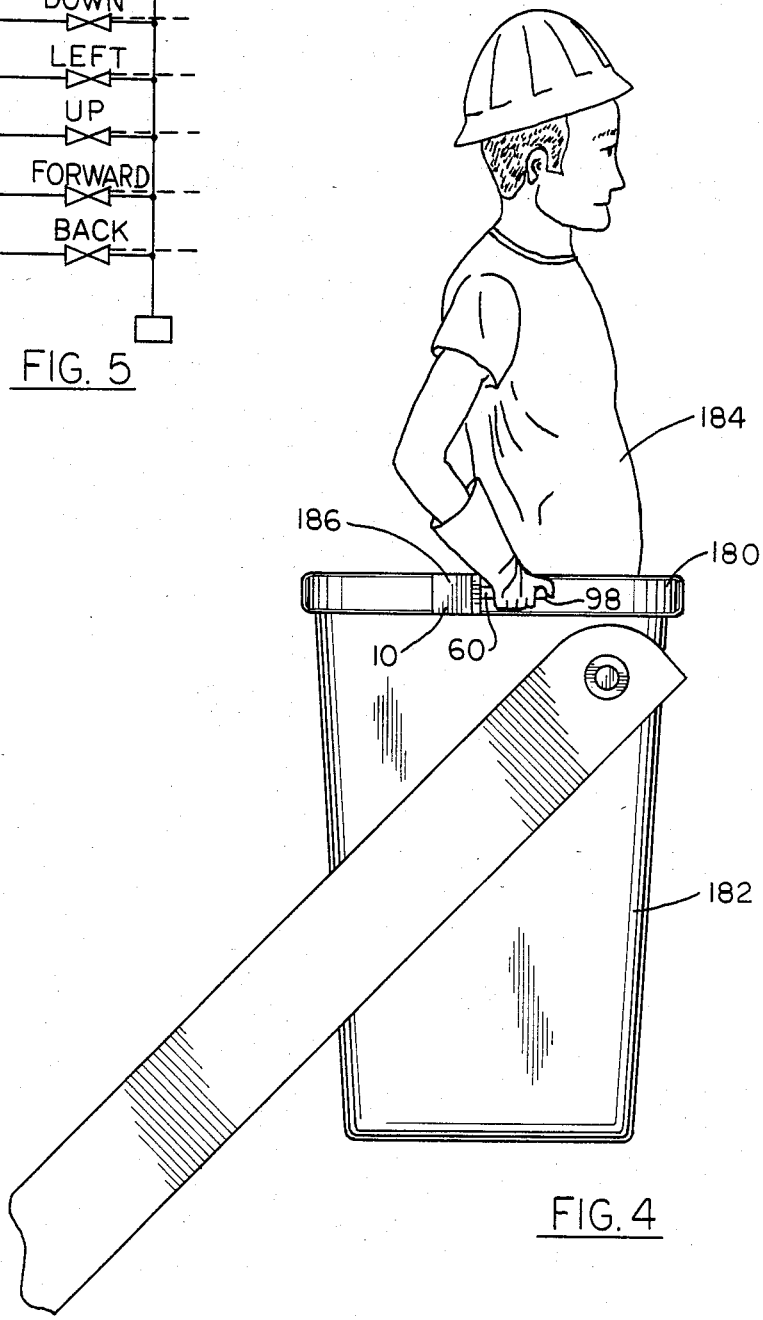
FIG. 4 is a side plan view showing installation of the operating wand on a typical personnel carrying bucket of an overhead personnel crane.

Referring now to FIG. 5, there shown in schematic form the connection of the switches 104, 112 through 118, and 152, 154 to the hydraulic control system of an overhead personnel crane.

The entire assembly 10 is mounted adjacent the upper periphery 180 of a personnel carrying bucket 182 in a position wherein the handle 60 can be easily grasped and manupulated by an operator 184. With the switches connected as shown in FIG. 5, it will now be seen that movement of the handle in an upward direction will result in upward movement of the bucket. Similarly, downward movement, right or left hand movement, or angular movement of the handle 60 will result in corresponding movement of the bucket 182. To prevent inadvertant operation or movement of the bucket 182, push botton 92 provides an interlock which prevents any signal from being transmitted from the switches 112 through 118 or 152, 154 to the hydraulic control system unless the button is depressed by the operators thumb.

All of the switches are received inside of a protective enclosure 186. Shaft 22 is enclosed by an accordion folded boot 188 to protect all of the components against dirt, damage, or other environmental factors.

In view of the above description, it will now be seen that the operating handle of the present invention provides an exceptionly convenient and predictable means for controlling movement of the personnel bucket 182. All movement occurs in exactly the same direction as movement of the operating handle. Bacause this movement corresponds to the normal movement of the operators hand, and because there is only one operating handle that must be manipulated, it is not necessary for the operator 184 to remove his eyes from his destination or work object thereby insuring more accurate positioning of the bucket 182. Further, since all of the movement results from a single operating handle responding to normal movement of the hand of the direction of desired movement, inadvertant movement of the bucket in an undesired direction cannot result by reason of the operator engaging or otherwise actuating an incorrect one of a plurality of buttons. This is particularly true when operators wearing work gloves, typically the case, which would interfer with his sense of touch. The structure is rugged and relatively fail safe, and does not add significantly to the cost of an overhead personnel crane while significantly enhancing the operating convenience thereof.

While there have been described above the principles of this invention in connection with specific apparatus, it is to be clearly understood that this description is made only by way of example and not as a limitation to the scope of the invention.

What is claimed is:

1. For use with an hydraulically driven overhead personnel crane which includes an elongated articulated arm having a personnel carrying enclosure secured to one end thereof and a plurality of hydraulic cylinders including electrically operated hydraulic cylinder control means operatively connected thereto for selectively controlling the operation of said hydraulic cylinders to maneuver said personnel enclosure in any selected direction in response to operation of one or more of said cylinders, a manually manipulated control wand apparatus for selectively actuating said electrically operated hydraulic control means comprising: a mounting base, an elongated tilting operator shaft pivotably coupled to said base for omnidirectional tilting movement, a first cam element fixedly secured to said tilting operator shaft, a first plurality of electrical switches each having a switch actuator and mounted to said base in an orthogonal array with said actuators adjacent said first cam, individual ones of said switches being operable in response to tilting of said shaft in a respective one of four orthogonally disposed directions towards individual ones of said switch actuators, adjacent ones of said switches being operable in response to tilting of said shaft in radial directions between said orthogonally disposed directions; a sliding operator shaft longitudinally slidably coupled to said tilting operator shaft, a second cam means fixedly secured to said sliding operator shaft, a pair of electrical switches each having a switch actuator and mounted to said tilting operator shaft in positions with said actuators in longitudinally spaced-apart relationship to adjacent ones of said second cam means, individual ones of said switches being operated in response to sliding movement of said sliding operator shaft in diametrically opposite directions; individual ones of said switches being operatively connected to predetermined ones of said hydraulic actuating means, said control wand apparatus being fixedly secured to said personnel carrier with said orthogonal axes disposed in directions corresponding to the direction of movement of said carrier resulting from actuation of that one of said switches disposed in said direction of movement.

2. The apparatus of claim 1 wherein said apparatus is fixedly secured to said personnel carrier in a position with said tilting first operator shaft disposed in a horizontal direction, there being one of said switch actuators of said first array of electrical switches disposed above, below, and to each side of said shaft, respectively, whereby movement of said tilting operator shaft in upward and lateral directions produces actuatioon of said switches and corresponding movement of said personnel carrier in the direction of said tilting movement.

3. The apparatus of claim 2 wherein said tilting operator shaft is hollow, said sliding operator shaft being slidably received therein and including a cam end portion extending outwardly from said tilting operator shaft, said second cam means being fixedly secured to the distal end of said outwardly extending cam portion.

4. The apparatus of claim 3 wherein said switch actuators include actuator buttons resiliently maintained in a first predetermined operating condition and being operable to a second operating condition in response to engagement of said respective actuator button with said cam means.

5. The apparatus of claim 4 wherein said sliding operator shaft further includes a handle portion fixedly secured to the end thereof distal said cam end portion, said tilting operator shaft being slidably engaged with said handle for sliding movement in a direction longitudinally thereof and interlockingly engaged therewith in lateral directions.

6. The apparatus of claim 5 wherein said tilting operator shaft includes a spherical portion, said mounting base including a socket laterally slidably and longitudinally interlockingly engaged said tilting operator shaft.

7. The apparatus of claim 6 wherein said mounting base includes a first mounting plate having a conical recess formed centrally therein, and a retainer plate having a second conical recess formed therein, said retainer plate being fixedly secured to said mounting plate in a position wherein said conical recesses are axially aligned with the larger diameter peripheries thereof being contiguous, said spherical portion being slidably received and slidably engaging the walls of said conical recesses and having a dimension larger than the smaller diameter of said conical recesses, the outside diameter of said tilting operator shaft being smaller than the smaller diameter of said conical recesses whereby the tilting operator shaft may be tilted with respect to said mounting base.

8. The apparatus of claim 1 further including a normally open momentary contact interlock switch fixedly secured to said handle wand adjacent the distal end thereof, said hydraulically operated personnel crane further including hydraulic system disabling means operatively connected to said interlock switch, said hydraulic system disabling means being rendered operable in response to closure of said interlock switch.

9. The apparatus of claim 8 wherein said interlock switch includes an actuator button slidably received in said wand, and spring means operatively engaging said button to thereby resiliently maintain said interlock switch in an open condition.

10. The apparatus of claims 1 further including centering means for resiliently maintaining said tilting operator shaft in a neutral, untilted position in the absence of lateral pressure thereon.

11. The apparatus of claim 10 wherein said centering means includes a collar having a flat base portion and slidably received on said tilting operator shaft in a position with said portion abutingly engaging said mounting base, spring means for resiliently pushing said collar against said mounting base, tilting movement of said tilting operator shaft compressing said spring means.

12. The apparatus of claim 11 further including a handle and a resilient dust boot fixedly secured between said handle and said base member, and a switch enclosure fixedly secured to said base member, the elements of said apparatus being received within one of said boot and said enclosure.

13. The apparatus of claim 12 wherein said first cam means element comprises a donut shaped cam fixedly secured to said tilting operator shaft in a position longitudinally displaced from said socket portion, said switch acutuator means being positioned in orthogonal relationship thereto with the actuating buttons thereof closely adjacent the periphery of said cam, said second cam means comprising a generally cylindrical cam element having tapered end surfaces, opposite ones of said tapered end surfaces engaging oppositely disposed ones of said second array pair of actuator switches in response to longitudinal sliding movement of said sliding operator shaft.

14. For use with a hydraulicaly driven overhead personnel crane which includes an elongated articulated arm having a personnel carrying enclosure secured to one end thereof and a plurality of hydraulic cylinders having electrically operated hydraulic control means operatively coupled thereto, said arm being moveable in vertical and horizontal directions in response to operation of individual ones of said electrically operated hydraulic control means for selectively controlling the operation of said hydraulic cylinders to maneuver said personnel enclosure in any direction, a manually manipulated control wand apparatus for selectively actuating said electrically operated hydraulic control means comprising: a mounting base, an elongated, hollow operator shaft pivotably coupled to said base for omnidirectional movement in a plane substantially perpendicular to the axis of said operator shaft; and a first orthogonal array of electrical switches fixedly mounted to said base adjacent said operator shaft and having switch actuating means for actuating individual ones of said switches in response to movement of said tilting operator shaft in the direction toward a respective one of said switches, and for actuating adjacent pairs of said switches in response to movement of actuating shaft in directions therebetween; a sliding operator shaft longitudinally, slidably received in said tilting operator shaft, a second array of electrical switches mounted to said pivotal operator shaft in longitudinally space-apart relationship, second switch actuator means for actuating individual ones of said second array of switches in response to longitudinal movement of of said sliding operator shaft, said base being fixedly secured to said personnel carrier in a position to orient said tilting and sliding actuator shafts in positions wherein movement thereof in a predetermined direction actuates a predetermined one of said electrical switches operatively coupled to activate the predetermined one of said hydraulic electrical control means which produces movement of said personnel carrier in the direction of said shaft movement.

15. The apparatus of claim 14 further including a normally open momentary contact interlock switch fixedly secured to said wand adjacent the distal end thereof, said hydraulically operated personnel crane further including hydraulic system disabling means operatively connected to said interlock switch, said hydraulic system disabling means being rendered operable in response to closure of said interlock switch.

16. The apparatus of claim 15 further including centering means for resiliently maintaining said pivotable operator shaft in a neutral, untilted position in the absence of lateral pressure thereon.

17. The apparatus of claim 16 wherein said centering means includes a collar having a flat base portion and slidably received on said pivotable operator shaft in a position with said portion abutingly engaging said mounting base, spring means for resiliently pushing said collar against said mounting base, movement of said pivotable operator shaft compressing said spring means.

18. The apparatus of claim 17 further including a handle and a resilient dust boot fixedly secured between said handle and said base member, and a switch enclosure fixedly secured to said base member, the elements of said apparatus being received within one of said boot and said enclosure.

19. The apparatus of claim 18 further including first cam means comprising a donut shaped cam fixedly secured to said pivotable operator shaft in a position longitudinally displaced from said socket portion, said switch actuator means being positioned in orthogonal relationship thereto closely adjacent the periphery of said cam, and second cam means comprising a generally cylindrical cam element having tapered end surfaces, opposite ones of said tapered end surfaces engaging oppositely disposed ones of said second array of switch actuators in response to longitudinal sliding movement of said sliding operator shaft.

* * * * *

UNITED STATES PATENT AND TRADEMARK OFFICE

CERTIFICATE OF CORRECTION

PATENT NO. : 4,520,894

DATED : June 4, 1985

INVENTOR(S) : David L. Hensler

It is certified that error appears in the above-identified patent and that said Letters Patent is hereby corrected as shown below:

Column 1, line 45, change "inadvertant" to --inadvertent--;
Column 1, line 58, change "inadvert" to --inadvertent--;
Column 1, line 63, change "personal" to --personnel--;
Column 2, line 1, add "the" after the word "for";
Column 2, line 17, change "if" to --in--;
Column 2, line 18, change "and" to --an--;
Column 2, line 41, delete "plan";
Column 2, line 44, delete "plan";
Column 2, line 47, delete "shematic" and insert --schematic--;
Column 2, line 56, change "numberal" to --numeral--;
Column 3, line 3, delete "desired or horizal";
Column 3, line 9, change "complementarly" to --complementary--;
Column 3, line 18, delete "46";

UNITED STATES PATENT AND TRADEMARK OFFICE

CERTIFICATE OF CORRECTION

PATENT NO. : 4,520,894

DATED : June 4, 1985

INVENTOR(S) : David L. Hensler

It is certified that error appears in the above-identified patent and that said Letters Patent is hereby corrected as shown below:

Column 3, line 21, change "deflected" to --tilted--;
Column 3, line 23, change "deflected" to --tilted--;
Column 3, line 30, delete "at 56";
Column 3, line 39, change "22" to --20--;
Column 3, line 42, change "Ratainer" to --Retainer--;
Column 3, line 42, after "secured" insert --to shaft 20--;
Column 3, line 43, after "and" insert --threads--;
Column 3, line 44, change "54" to --20--;
Column 3, line 52, changte "portion" to --position--;
Column 3, lines 55 and 56, delete "shaft 82 being secured by means of threads 87";
Column 3, line 64, change "abuttingly" to --abuttingly--;

UNITED STATES PATENT AND TRADEMARK OFFICE

CERTIFICATE OF CORRECTION

PATENT NO. : 4,520,894

DATED : June 4, 1985

INVENTOR(S) : David L. Hensler

It is certified that error appears in the above-identified patent and that said Letters Patent is hereby corrected as shown below:

Column 3, line 67, change "compressably" to --compressibly--;
Column 4, line 1, after "contact" insert --106--;
Column 4, line 15, after "one" insert --of,--;
Column 4, line 15, after "of", second occurrence, insert --,--;
Column 4, line 24, after "118" insert --and--;
Column 4, line 24, after "112", second occurrence, insert --and--;
Column 4, line 29, after "162" insert --,--;
Column 4, line 29, after "respectively" insert --,--;
Column 4, line 33, after "there" insert --is--;
Column 4, line 40, change "manupulated" to --manipulated--;

UNITED STATES PATENT AND TRADEMARK OFFICE

CERTIFICATE OF CORRECTION

PATENT NO. : 4,520,894

DATED : June 4, 1985

INVENTOR(S) : David L. Hensler

It is certified that error appears in the above-identified patent and that said Letters Patent is hereby corrected as shown below:

Column 4, lines 46 and 47, change "inadvertant" to --inadvertent--;
Column 4, line 48, change "botton" to --button--;
Column 4, line 53, change "22" to --20--;
Column 4, line 53 and 54, after "accordion" add "-";
Column 4, line 61, change "Bacause" to --Because--;
Column 4, line 63, change "operators" to --operator's--;
Column 4, line 66, after "object" insert --,--;
Column 5, line 1, change "of" to --in--;
Column 5, line 2, change "inadvertant" to --inadvertent--;
Column 5, line 6, after "when" insert --the--;
Column 5, line 6, change "operators" to --operator is--;
Column 5, line 7, change "interfer" to --interfere--;

UNITED STATES PATENT AND TRADEMARK OFFICE

CERTIFICATE OF CORRECTION

PATENT NO. : 4,520,894

DATED : June 4, 1985

INVENTOR(S) : David L. Hensler

It is certified that error appears in the above-identified patent and that said Letters Patent is hereby corrected as shown below:

Claim 2, column 5, line 63, delete "first";
Claim 8, column 6, line 43, change "handle" to --wand--;
Claim 13, column 7, line 4, delete "means";
Claim 13, column 7, line 6, change "socket portion" to --pivotal coupling--;
Claim 13, column 7, line 13, delete "second array";
Claim 17, column 8, line 27, inserting --tilting-- before the word "movement".

Signed and Sealed this

*Twenty-ninth* Day of *April 1986*

[SEAL]

*Attest:*

DONALD J. QUIGG

*Attesting Officer*

*Commissioner of Patents and Trademarks*